US006196192B1

(12) United States Patent
Ciecko

(10) Patent No.: US 6,196,192 B1
(45) Date of Patent: Mar. 6, 2001

(54) FUEL DISPENSING DEVICE FOR AN INTERNAL COMBUSTION ENGINE

(75) Inventor: Daniel Ciecko, Brie-Comte-Robert (FR)

(73) Assignee: C I D E B, Fontenay-Tresigny (FR)

( * ) Notice: Subject to any disclaimer, the term of this patent is extended or adjusted under 35 U.S.C. 154(b) by 0 days.

(21) Appl. No.: 09/462,885

(22) PCT Filed: May 18, 1999

(86) PCT No.: PCT/FR99/01180

§ 371 Date: Mar. 29, 2000

§ 102(e) Date: Mar. 29, 2000

(87) PCT Pub. No.: WO99/60263

PCT Pub. Date: Nov. 25, 1999

(30) Foreign Application Priority Data

May 19, 1998 (FR) ..... 98 06306

(51) Int. Cl.[7] ..... F02M 33/04
(52) U.S. Cl. ..... 123/456; 123/468
(58) Field of Search ..... 123/456, 468, 123/469, 470, 472

(56) References Cited

U.S. PATENT DOCUMENTS 5,471,959 * 12/1995 Sturman ..... 123/456
6,096,119 * 8/2000 Maier et al. ..... 123/456

FOREIGN PATENT DOCUMENTS 196 47 049 6/1998 (DE) .
427 977 5/1991 (EP) .

* cited by examiner

*Primary Examiner*—Thomas N. Moulis
(74) *Attorney, Agent, or Firm*—Browdy and Neimark

(57) ABSTRACT

The invention concerns a fuel dispensing device, in particular for an engine supplied under relatively high pressure. The invention is characterised in that the fuel-dispensing pump comprises a hollow body (12) where are arranged the passages (14) and inside which is provided a substantially spherical cavity (17) part (18) and a plugging arrangement (30) screwed in the hollow body. The plugging arrangement can be mounted in the pump outlet.

18 Claims, 3 Drawing Sheets

Figure 13:
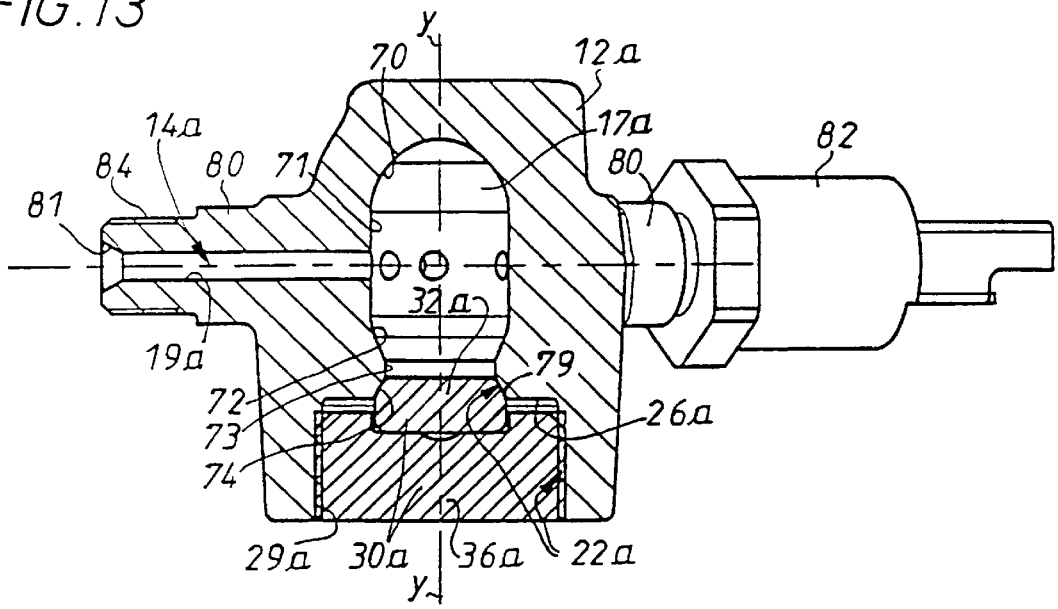

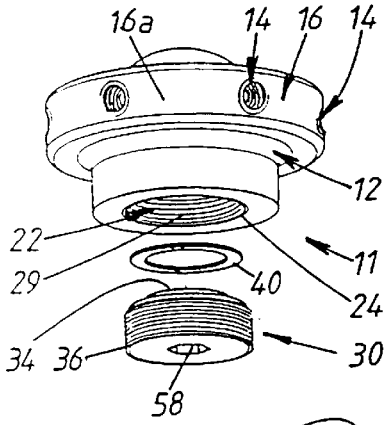
FIG 1
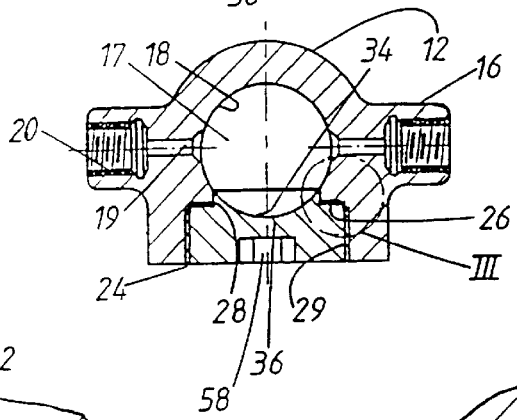
FIG 2
FIG 3
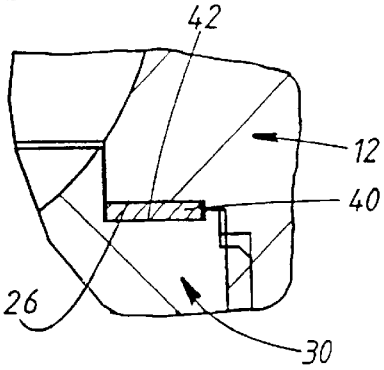
FIG 4
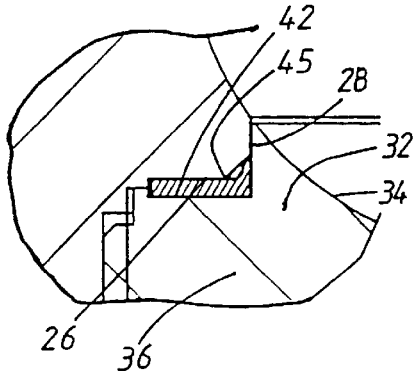
FIG 5
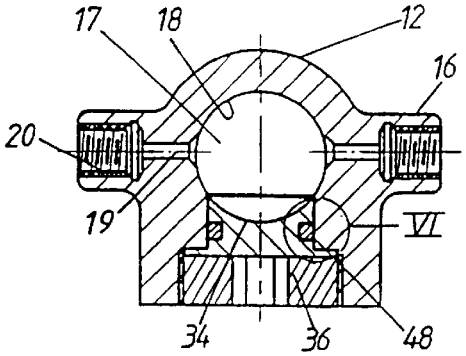
FIG 6
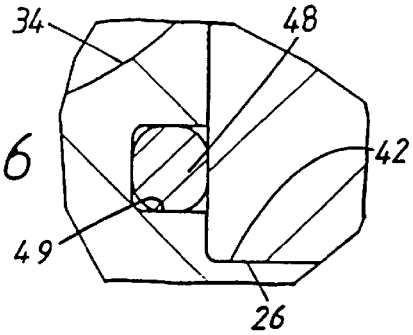

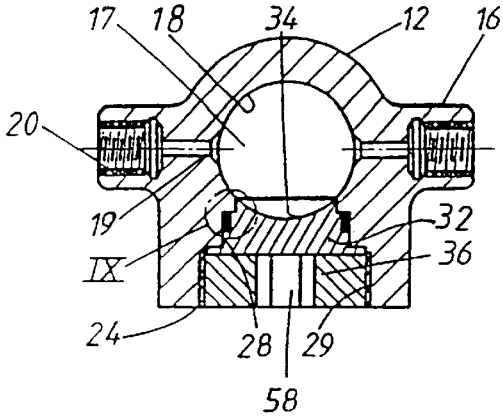
FIG 8
FIG 7
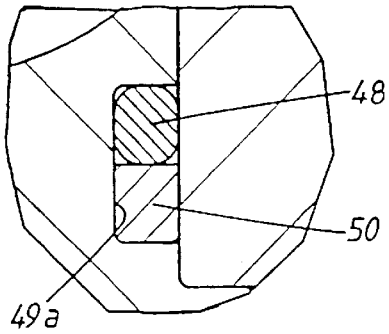
FIG 9
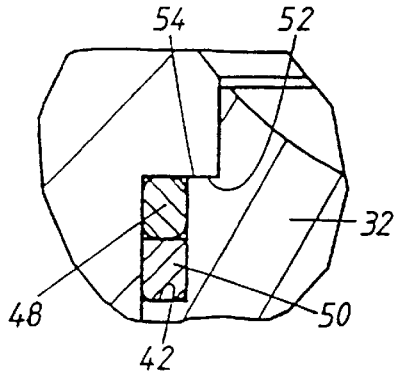
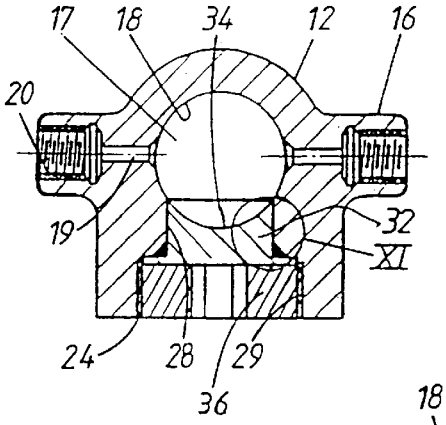
FIG 10
FIG 11
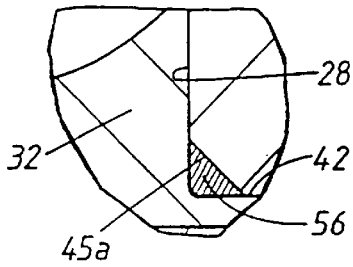
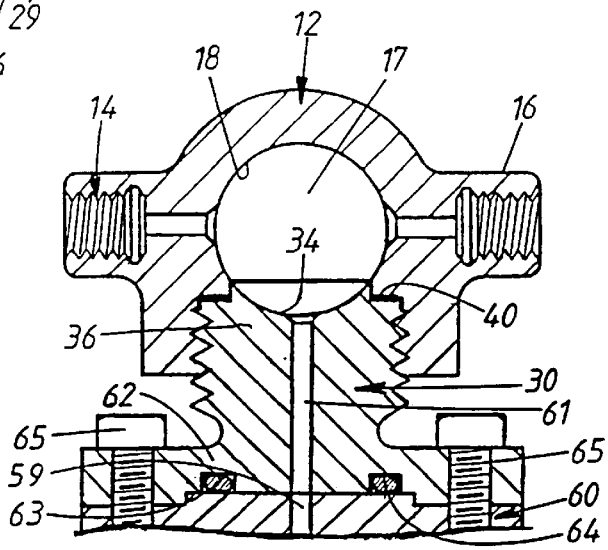
FIG 12

FUEL DISPENSING DEVICE FOR AN INTERNAL COMBUSTION ENGINE

This application is the national phase of international application PCT/FR99/01180 filed May 18, 1999 which designated the U.S.

The invention concerns a fuel distribution system for feeding the cylinders of an internal-combustion engine, in particular a fuel-injected engine and more particularly still an engine fed at a relatively high pressure.

The invention relates more particularly to a new method of making a system of the above kind, which is easy to fabricate, easy to install and low in cost.

In a fuel-injected internal-combustion engine, the fuel distributor conventionally includes an elongate, generally tubular body connected by one axial end to the outlet of a fuel pump and having a plurality of outlets in the form of projecting bosses along its length. The outlets are connected to the various injectors. Other connections may be provided for connection to pressure and/or temperature sensors, a damper or a regulator. The elongate tubular body is difficult to make. It requires a heavy one-piece component that requires finish-machining.

An elongate tubular body of the above kind also incorporates a plurality of supports or attachment lugs for fixing it to the engine block. In practice the very shape of a distributor of the above kind and the need to fix it at a number of points necessitate a specific design for each type of engine.

European patent application No 0 427 977 describes a distributor including a short elongate cavity mounted on a base incorporating a pressure and/or temperature sensor. The ports of the cavity including an inlet connected to the pump and outlets connected to the injectors are grouped together at one end of the body. These ports communicate with the cavity via bores. Most of the bores are at a slant and open into the upper part of the cavity. A distributor of the above kind is difficult and costly to make. The walls of the body are relatively thick and the component is heavy.

The invention proposes a new type of fuel distribution system which is easy to mass produce at relatively low unit cost.

One object of the invention is to propose a small and light distributor which is particularly highly resistant to high pressures.

Another object of the invention is to propose a distributor of the above kind which can have a large number of ports for connection to the various cylinders and sensors of the engine and which can be disposed at numerous locations on said body.

Another object of the invention is to propose a distributor in which the cavity is of particularly small volume but nevertheless capable of feeding at a high pressure a relatively large capacity engine, all other things being equal.

The invention relates more particularly to a distribution system for feeding the cylinders of an internal-combustion engine, of the type including a hollow body in the wall of which are formed ports adapted to be connected, in particular, to a supply of fuel under pressure and to a plurality of injectors for feeding said cylinders, characterized in that said hollow body includes a part of a cavity which is at least approximately spherical or has an oblong profile and a shouldered bore extending substantially radially between said cavity part and an orifice of said body, said bore including, separated by a shoulder, an interior first section communicating with said cavity part and a threaded exterior second section, and in that an arrangement for plugging said bore has an inside part engaged in said first section, constituting a part of the inside face of said cavity, and a threaded part screwed into said second section.

The cavity can be spherical, substantially spherical or have a slightly oblong profile.

The inside part of the plugging arrangement can include a recess completing said cavity. A seal can be disposed between the plugging arrangement and said bore.

The spherical or practically spherical shape of the cavity is advantageous because all the ports can communicate with the cavity via bores whose inside end parts, at least, are substantially radial. This means that the ports can be anywhere on the body all around the spherical or practically spherical cavity.

Most importantly, the screwed assembly of the hollow body and the plugging arrangement reduces very substantially the manufacturing costs for an astonishingly high resistance to pressure.

In various embodiments of the invention the inside part of the plugging arrangement is separate from the threaded part. The inside part can include a first shoulder cooperating with that of the bore, in which case the seal between said body and said inside part cannot be damaged when said threaded part is screwed on. This shoulder is referred to hereinafter as the "first shoulder".

The seal can be accommodated in an annular groove formed in a cylindrical portion of said inside part. This seal can also be compressed between two shoulders, one of which is that of said bore. The shoulder of the bore can be beveled to create an annular space adapted to house a seal of appropriate shape.

There can also be an at least relatively flat seal disposed between the shoulder of the bore and said first shoulder of said inside part. As before, the shoulder of said shouldered bore can be beveled to define an enlarged annular space with said first shoulder of said inside part.

In this case, said relatively flat seal includes an annular increased thickness in the vicinity of its inside edge adapted to occupy the enlarged annular space.

In some cases the inside part of the plugging arrangement and the threaded part can be in one piece.

Finally, in accordance with another advantageous feature of the invention, the volume of the cavity can be relatively small compared to the cylinder capacity of the engine to be fed. For example, for a 6-cylinder 2.5 liter engine with direct injection at a pressure in the order of 1500 bars, the volume of the cavity can be 30 $cm^3$.

The invention will be better understood and other advantages of the invention will be become more clearly apparent in the light of the following description of various embodiments of a fuel distribution system in accordance with the invention, given by way of example only and with reference to the accompanying drawings, in which:

FIG. 1 is an exploded perspective view of a fuel distribution system in accordance with the invention, FIG. 2 is a view of the same device, assembled, showing a diametral section of the cavity, FIG. 3 is a view to a larger scale of the detail III in FIG. 2, FIG. 4 is a detailed view similar to FIG. 3 showing a variant of the seal of the device from FIGS. 1 and 2, FIG. 5 is a view analogous to FIG. 2 showing a variant, FIG. 6 is a view to a larger scale of the detail VI in FIG. 5, FIG. 7 is a view analogous to FIG. 6 showing a variant, FIG. 8 is a view analogous to FIG. 5 showing another variant, FIG. 9 is a view to a larger scale of the detail IX from FIG. 8, FIG. 10 is a view analogous to FIG. 5 showing another variant, FIG. 11 is a view to a larger scale of the detail XI in FIG. 10, FIG. 12 shows another variant enabling direct mounting on the pump, and FIG. 13 is a sectional view of a variant of the system in accordance with the invention.

FIGS. 1 to 3 show a fuel distribution system 11 for feeding the cylinders of a direct fuel injection internal-combustion engine, for example a diesel or petrol engine, at a relatively high pressure.

In this type of engine, not shown, the fuel is delivered to the system at high pressure by a pump and is distributed to injectors controlled by solenoid valves. The pressures involved are in the order of 100 to 150 bars for a petrol engine and 1400 to 2000 bars for a diesel engine. The distribution system essentially comprises a hollow body 12 in the wall of which are formed ports 14 adapted to be connected, in particular, to a source of fuel under pressure (the pump) and to a plurality of injectors feeding the respective cylinders of the engine. In the example shown, the various ports are not differentiated. They are formed on a solid ring 16 in one piece with said hollow body, possibly cast, forged or otherwise manufactured in one piece with it.

Other similar ports can be used to connect control means such as a regulator and/or a damper and/or a pressure connection, for example. The hollow body includes a part 18 of a substantially spherical cavity 17. Said cavity part in the hollow body is here substantially larger than a hemisphere. As a general rule, it must constitute at least half of the cavity, and in the case of a strictly spherical cavity, at least a hemisphere. The solid ring 16 in which said ports are formed has its median plane coincident with an equatorial plane of the spherical cavity 17. If the cavity had a general shape that were not strictly spherical, for example a slightly oblong profile, the massive ring could advantageously have its median plane coincident with a transverse plane of symmetry of said cavity. However, if necessary, there can be other ports at other locations all around said hollow body. Each port 14 includes a narrow, substantially radial hole 19 and a larger diameter threaded hole 20 opening to the outside, here onto the ring 16, and connected to the narrow hole.

Each narrow hole 19 is preferably perpendicular to the outside surface 16*a* of the ring, i.e. radial relative to the cavity 17 when this is spherical.

The hollow body also includes a shouldered bore 22 extending substantially radially between said cavity part 16 and an orifice 24 of the hollow body. This bore includes, separated by a shoulder 26, an interior first section 28 communicating with said cavity part 17 defined in said body and a threaded exterior second section 29. The system is completed by an arrangement 30 for plugging the shouldered bore 22. The plugging arrangement includes an interior part 32 engaged in said first section and an end face of which includes a recess 34 completing said cavity, i.e. connected to the cavity part 16 defined in said body, and a threaded part 36 screwed into said second section 29. At least one seal 40 is disposed between said plugging arrangement 30 and the bore 22.

In the example shown in FIGS. 1 to 3, said interior part and said threaded part of the plugging arrangement 30 are in one piece. Here the seal 40 is a relatively flat seal disposed between the shoulder 26 of the bore and a shoulder 42 of the part, here defined between said interior part 32 and said threaded part 36. The shoulder 42 is referred to as the "first shoulder".

In the FIG. 4 variant, the inside edge of the shoulder of said shouldered bore 22 formed in the body is beveled (bevel 45) to define an enlarged annular space with the single component consisting of said interior part 32 and said threaded part 36. The at least relatively flat seal nevertheless has an annular increased thickness portion in the vicinity of its inside edge adapted to occupy this enlarged annular space.

As is clear from FIG. 4, a seal is obtained at five consecutive faces.

In all the other embodiments described hereinafter the interior part 32 is separate from the threaded part 36. However it is clear that the flat or relatively flat seals described above can be used with the embodiments of FIGS. 5 to 9 and that all the other seals described hereinafter can also be used in the embodiment of FIGS. 1 to 3.

FIGS. 5 and 6 show that the interior part 32 includes a first shoulder 42 cooperating with that of the bore (shoulder 26). An O-ring 48 is accommodated in an annular groove 49 in a cylindrical part of said interior part.

In FIG. 7, a similar annular groove 49*a* accommodates an anti-extrusion ring 50 adjoining said seal 48.

In the embodiment shown in FIGS. 8 and 9, said first section of the shouldered bore (i.e. the non-threaded section) includes another shoulder 52 cooperating with a second shoulder 54 of said interior part 32. At least one seal 48 is clamped between said first shoulder 42 and said other shoulder 52.

In the example shown, and as shown in more detail in FIG. 9, an anti-extrusion ring 50 is abutted against the seal 48 and the combination is clamped between the two shoulders.

In the embodiment shown in FIGS. 10 and 11, the interior part 32 is again separate from the threaded part 36 and the inside edge of the shoulder of the shouldered bore is beveled (bevel 45*a*) to define an enlarged space, which here is frustoconical, with said interior part 32, in particular its shoulder 42 (previously referred to as the first shoulder) and a seal 56 with an appropriate shape (triangular section annular seal) to occupy this frustoconical annular space.

In all the embodiments described so far the outside face of the second section includes an imprint 58 adapted to receive a screwing tool.

In the examples described, this imprint is in the form of a hexagonal hole. Other equivalent shapes could be suitable.

Note that the screwed assembly between said body and the plugging arrangement has been found to be advantageous from the point of view of the unit price of a system of this kind. Surprisingly, the resistance of an arrangement of this kind to internal pressure has been found to be exceptionally high. Tests have shown that a system of the above kind can withstand internal pressures more than twice the maximum pressure needed to feed a direct-injection diesel engine at high pressure.

Finally, the process of developing the system revealed that the volume of the cavity could be very much smaller than that usually employed and made necessary by the elongate tubular shape of conventional inlet devices. It can been shown that the small volume of the cavity (encouraging a good seal of the plugging arrangement) can be reduced very greatly compared to the usual values without disrupting distribution.

Finally, FIG. 12 shows an application of practical advantage.

In this variant, the plugging arrangement 30 (at least its threaded part 36) is combined with the outlet 59 of the injection pump 60.

In this case, the threaded part 36 includes a base 62 forming a flange with a groove 63 on its bottom face accommodating a seal 64. The fuel is therefore injected radially via a very small diameter pipe 61 extending the outlet 59. The base 62 is fixed to the end of the pump by screws 65.

Another possibility is for the threaded part 36 to be formed all around the outlet 59 of the pump itself and for the hollow body 12 to be screwed to the pump, with the seal 40 between them. The end of the outlet 59 of the pump would then be shaped to incorporate the recess 34, and would therefore be adapted to form one part of the distributor (the plugging arrangement). This constitutes another important advantage of the screwed assembly of the distributor components. Of course, all the embodiments described above can be mounted at the pump outlet.

In the embodiment described next, structural members similar to those of the previous embodiments are identified by the same reference number with the suffix a.

FIG. 13 shows another embodiment in which the cavity 17*a* is of slightly different shape. Instead of a sphere, the shape is approximately oval or has a slightly oblong profile; it nevertheless has an axis of symmetry y—y which is also that of said shouldered bore 22*a*. To be more precise, in this embodiment, the part of the cavity defined in the hollow body 12*a* includes a substantially spherical end part 70 extended by a cylindrical portion 71 (12 to 20 mm long, for example) into which the ports 14*a* discharge. This cylindrical portion is itself extended by a neck 72 whose cross-section progressively reduces toward the outside. This neck is extended by said shouldered bore whose inside section includes a cylindrical portion 73 and then a frustoconical bearing surface 74 widening toward the shoulder. The frustoconical bearing surface 74 terminates in the plane of the shoulder 26*a*.

In a similar manner to the embodiments shown in FIGS. 5, 8 and 9, the plugging arrangement 30*a* has two separate parts. The cavity is closed by an inside part 32*a* engaged in the first section; it constitutes a part of the internal face of the cavity 17*a*. This inside part is held in place by a threaded part 36*a* screwed into said second section 29*a*, which is threaded for this purpose.

In this embodiment, the inside part of the plugging arrangement is in the general shape of a relatively thick disk with a frustoconical peripheral portion 79 pressed against the frustoconical bearing surface 74 defined above. The threaded part includes a recess in which is engaged the inside part 32*a* which forms a kind of frustoconical bearing surface plug.

The seal is assured by intimate contact between the frustoconical surfaces 74 and 79. However, a relatively compressible additional seal (not shown) can be disposed between the shoulder 26*a* in the body 12*a* and the end face of the threaded part 36*a*.

The ports 14*a* are respectively defined in solid extensions of said body, which extensions form connecting pieces 80. Each port includes a narrow hole 19*a* discharging in a substantially equatorial plane of the cavity (perpendicular to the axis y—y). It opens to the outside via a conical embouchure 81 and the end piece 80 has an outside thread 84 at its end.

FIG. 13 shows one of the end pieces equipped with a pressure sensor 82. The outside thread can be advantageous.

If small metal particles are torn off when tightening the pipe connector, they cannot be entrained toward the inlet system when the distributor operates.

What is claimed is:

1. Fuel distribution system for feeding the cylinders of an internal-combustion engine, of the type including a hollow body (12) in the wall of which are formed ports (14) adapted to be connected, in particular, to a supply of fuel under pressure and to a plurality of injectors for feeding said cylinders, characterized in that said hollow body (12) includes a part (18) of a cavity (17) which is at least approximately spherical or has an oblong profile and a shouldered bore (22) extending substantially radially between said cavity part and an orifice of said body, said bore including, separated by a shoulder, an interior first section (28) communicating with said cavity part and a threaded exterior second section (29), and in that an arrangement (30) for plugging said bore has an inside part engaged in said first section, constituting a part of the inside face of said cavity, and a threaded part (36) screwed into said second section.

2. System according to claim 1, characterized in that one face of said inside part includes a recess completing said cavity.

3. System according to claim 1, characterized in that a seal (40) is disposed between said plugging arrangement and said bore.

4. System according to claim 1, characterized in that said inside part is separate from said threaded part (FIG. 5).

5. System according to claim 1, characterized in that said inside part includes a first shoulder (42) cooperating with said bore.

6. System according to claim 4, characterized in that a seal (48) is accommodated in an annular groove formed in a cylindrical portion of said inside part.

7. System according to claim 6, characterized in that said annular groove also accommodates an anti-extrusion ring (50) adjoining said seal.

8. System according to claim 5, characterized in that said first section of said shouldered bore includes another shoulder (52) cooperating with a second shoulder (54) of said inside part, a seal being clamped between said second shoulder and said other shoulder.

9. System according to claim 4, characterized in that the inside edge of the shoulder of said shoulder bore is beveled to define an enlarged annular space with said first shoulder of said inside part and in that said seal has a shape adapted to occupy said enlarged annular part.

10. System according to claim 4, characterized in that said seal is an at least relatively flat seal (40) disposed between the shoulder of said bore and said first shoulder of said inside part.

11. System according to claim 10, characterized in that the inside edge of the shoulder of said shouldered bore is beveled (45) to define an enlarged annular space with said first shoulder of said inside part and in that said at least relatively flat seal includes an annular increased thickness in the vicinity of its inside edge adapted to occupy said enlarged annular space.

12. System according to claim 1, characterized in that said inside part and said threaded part are in one piece.

13. System according to claim 1, characterized in that the outside face of said second section includes an imprint (58) adapted to receive a screwing tool, for example an imprint in the form of a hexagonal hole.

14. System according to claim 1, characterized in that it is combined with a pump, said threaded part (36) being provided with a base (62) forming a flange fixed to the end of said pump and including a pipe (61) extending the outlet (59) of the pump.

15. System according to claim 1, characterized in that it is combined with a pump (60), said hollow body (12) being screwed directly to an adapted outlet of a pump of this kind.

16. System according to claim 1, characterized in that said inside section of said shouldered bore includes a frustoconical bearing surface (74) widening toward the shoulder and in that said inside part of said plugging arrangement includes a frustoconical portion (79) pressed onto said frustoconical bearing surface.

17. System according to claim 1, characterized in that said body includes connecting end-pieces (80) each of which has an outside thread (84) at its end.

18. System according to claim 17, characterized in that each connecting end-piece (80) incorporates a narrow hole **(19*a*)**.

* * * * *